United States Patent [19]

Binder et al.

[11] Patent Number: 4,744,489

[45] Date of Patent: May 17, 1988

[54] STORE DISPLAY FIXTURE

[75] Inventors: J. Morris Binder, West Des Moines, Iowa; Archie G. Drummond, Jr., Palatine; Dale E. Fahnstrom, Riverside, both of Ill.

[73] Assignee: Tone Brothers, Inc., Des Moines, Iowa

[21] Appl. No.: 801,191

[22] Filed: Nov. 22, 1985

[51] Int. Cl.[4] ..... A47F 3/14; A47F 3/06

[52] U.S. Cl. ..... 221/6; 221/108; 221/111; 221/133; 221/194; 211/59.2; 211/128; 312/45

[58] Field of Search ..... 221/2, 4, 6, 97, 104, 221/105, 107, 108, 109, 111, 11, 14, 130, 131, 133, 194, 197, 103, 106, 311, 191; 211/126, 128, 59.2, 59.4; 312/42, 45, 72

[56] References Cited

U.S. PATENT DOCUMENTS

| | | | |
|---|---|---|---|
| 1,189,371 | 7/1916 | Lyons | 211/128 |
| 1,291,420 | 1/1919 | Cough | 221/279 X |
| 1,393,964 | 10/1921 | Potts et al. | 221/6 X |
| 2,124,500 | 7/1938 | Taylor | 221/109 |
| 2,382,191 | 8/1945 | Weichselbaum | 211/59.2 X |
| 2,784,871 | 3/1957 | Gabrielsen | 221/19 X |
| 2,852,327 | 9/1958 | Mason | 312/45 |
| 3,231,323 | 1/1966 | Wells et al. | 221/6 X |
| 3,270,916 | 9/1966 | Lyman | 221/6 |
| 3,318,455 | 5/1967 | Takahashi | 211/59.2 |
| 3,613,946 | 10/1971 | Klem | 221/109 |
| 3,895,724 | 7/1975 | Thompson et al. | 221/22 X |
| 4,347,952 | 9/1982 | Bookout | 221/129 |

FOREIGN PATENT DOCUMENTS

| | | | |
|---|---|---|---|
| 552316 | 1/1958 | Canada | 211/59.2 |
| 523003 | 8/1976 | U.S.S.R. | 211/59.2 |

*Primary Examiner*—Joseph J. Rolla
*Assistant Examiner*—Edward S. Ammeen
*Attorney, Agent, or Firm*—Berman, Aisenberg & Platt

[57] ABSTRACT

A rack for display of articles comprises a plurality of trays for holding the articles. Each tray comprises upper and lower courses connected at opposite ends. At one end, an upper course communicates with the lower course by means of a gate. The gate is controlled by the presence of objects in the lower course so that objects from the upper course are transmitted to the lower course only after the lower course is empty. The gate includes a flag for indicating when the objects are being supplied from the upper gate. Trays are moveable between dispensing and loading positions. In the loading position, objects may be easily placed in the upper course so that they are passed to the lower course when the upper course becomes full. The objects are preferably cylindrical, and the course are arranged to allow the objects to roll along the courses to facilitate dispensing and loading.

12 Claims, 4 Drawing Sheets

STORE DISPLAY FIXTURE

TECHNICAL FIELD

This invention relates to the art of display racks. The invention finds particular utility in the display and dispensing of small containers, for example, spice containers.

BACKGROUND ART

It is known to provide display racks for cylindrical containers. In the typical rack, the containers are arranged in rows wherein each row extends from the front of the rack to the rear at a slight angle to the horizontal. When the container is removed from a row, the remaining containers slide forwardly until the front container engages a front stop. U.S. Pat. Nos. 1,291,420 (Cough) and 3,895,724 (Thompson et al) are representative of these structures.

It is also known to provide a dispensing machine, for example for cans of soda, wherein the cans roll along a sinuous path from top to bottom. When a can is removed from the bottom of the rack, the remainder of the cans roll along the path until the front-most can engages a stop. This type of mechanism is not typically used in a store display rack and is instead part of a large vending machine. U.S. Pat. No. 4,347,952 (Bookout) shows this type of machine.

It is also known to provide a mechanism to indicate when a course of objects is empty. For example, see U.S. Pat. Nos. 3,270,916 (Lyman), 1,393,964 (Potts et al), and 2,784,871 (Gabrielsen).

SUMMARY OF THE INVENTION

The display or dispensing devices known in the art suffer from several disadvantages. The rack employing horizontal rows of objects requires a large number of objects if the device is to appear full to a customer. This is important in retail marketing because many articles, such as spices, need to be stocked in only small quantities during certain times of the year. A display is much more attractive if it appears full, and this is possible with prior art structures only if a large inventory is maintained.

Prior art structures also are difficult to re-stock. It is desirable to provide a first-in first-out system whereby the oldest articles are placed in the front of the display. In the type of display simply having rows, it is time-consuming to remove the unsold articles, load the new ones in the rear and then re-load the unsold ones in the front.

In accordance with the invention, a unique display rack is provided wherein a support structure holds a plurality of trays. Each of the trays is moveable with respect to the structure to provide a loading position and a disbursing position. The tray includes upper and lower courses, and the upper course communicates with the lower course at both of its ends. One end of the upper course includes a moveable gate which prevents objects in the upper course from passing to the lower course when the lower course contains articles. When the lower course is empty, the gate pivots to provide a ramp for objects in the upper course to fall into the lower course for dispensing. While a pivotal gate is preferred, other mechanisms are possible.

The moveable gate includes a flag which is pivoted out of view when objects are in the lower course and pivoted into a position for easy viewing when the lower course is empty. This allows a supplier to easily recognize when re-stocking is necessary.

When re-stocking, the articles are placed in the upper course and pushed rearwardly along the course until they fall into the lower course at the end remote from the gate. The articles then roll or slide to the front of the lower course to insure that the oldest articles are dispensed first.

The gate arrangement at one end of the upper course assists in ensuring that the oldest articles are dispensed first by allowing articles in the upper course to fall into the lower course only after the lower course is empty. In addition, by providing a ramp for articles to fall into the lower course, the display always appears to be full, thus presenting a pleasing appearance to consumers with a minimum inventory level.

It is an object of this invention to provide a display rack having unique dispensing trays.

Another object of this invention is to provide a dispensing tray having upper and lower courses which communicate with each other at two locations.

Still another object of this invention is to provide a dispensing tray having an indicator for giving a visual indication of the quantity of the articles in the tray.

Yet another object of this invention is to provide a unique dispensing tray which maintains a full appearance for even a small number of articles.

DETAILED DESCRIPTION OF THE DRAWINGS

Figure 1:
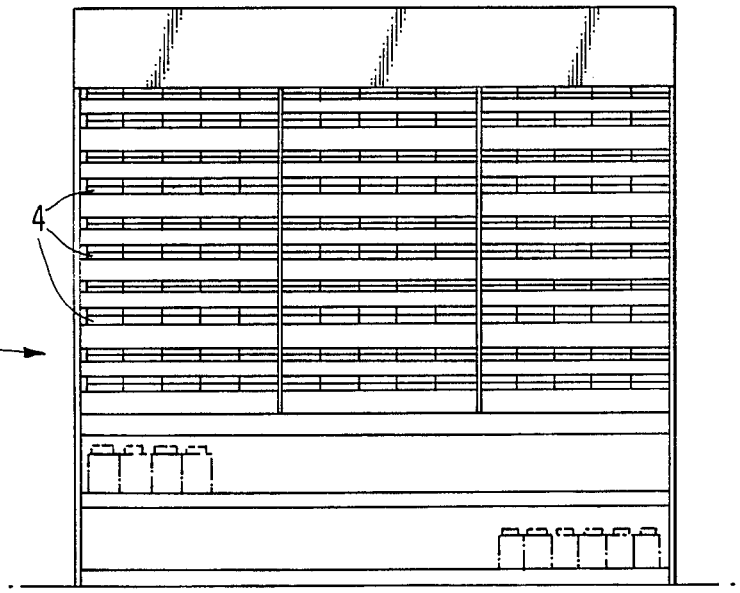
FIG. 1 is a front view of a display rack in accordance with the invention.

FIG. 1 is a front view of a display rack 2. The rack supports a plurality of dispensing trays 4 which will be more fully described below as well as shelves for holding other containers.

Figure 2:
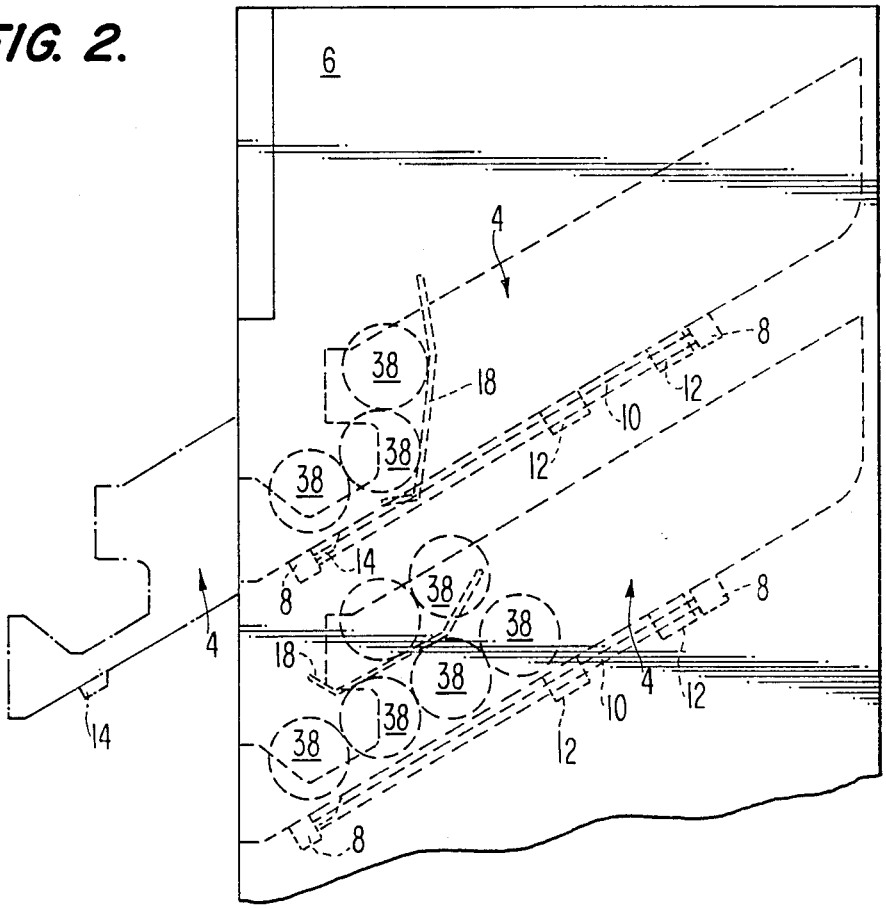
FIG. 2 is a side view of the rack shown in FIG. 1 showing dispensing trays in phantom lines.

FIG. 2 is a side view of the display rack shown in FIG. 1 and shows the inventive dispensing trays in dashed lines. Side walls 6 of the rack 2 are attached to horizontal brackets 8 which extend across the display rack between the side walls. It will be appreciated that the brackets are tilted forwardly to provide an elevated rear. Extending between adjacent brackets 8 are support rods 10 which are preferably cylindrical but may be of various shapes.

As shown in FIG. 2, each tray 4 includes clips 12 which engage support rods 10 to secure trays 4 to display rack 2. Clips 12, however, allow trays to slide with respect to support rods 10 to allow a tray 4 to be moved between two positions as shown in FIG. 2. Tabs 14 extend downwardly from the bottom surface of tray 4 to engage the front-most bracket 8 to hold tray 4 in either the dispensing position shown in dashed lines in FIG. 2 or the loading position shown in chained lines.

Figure 3:
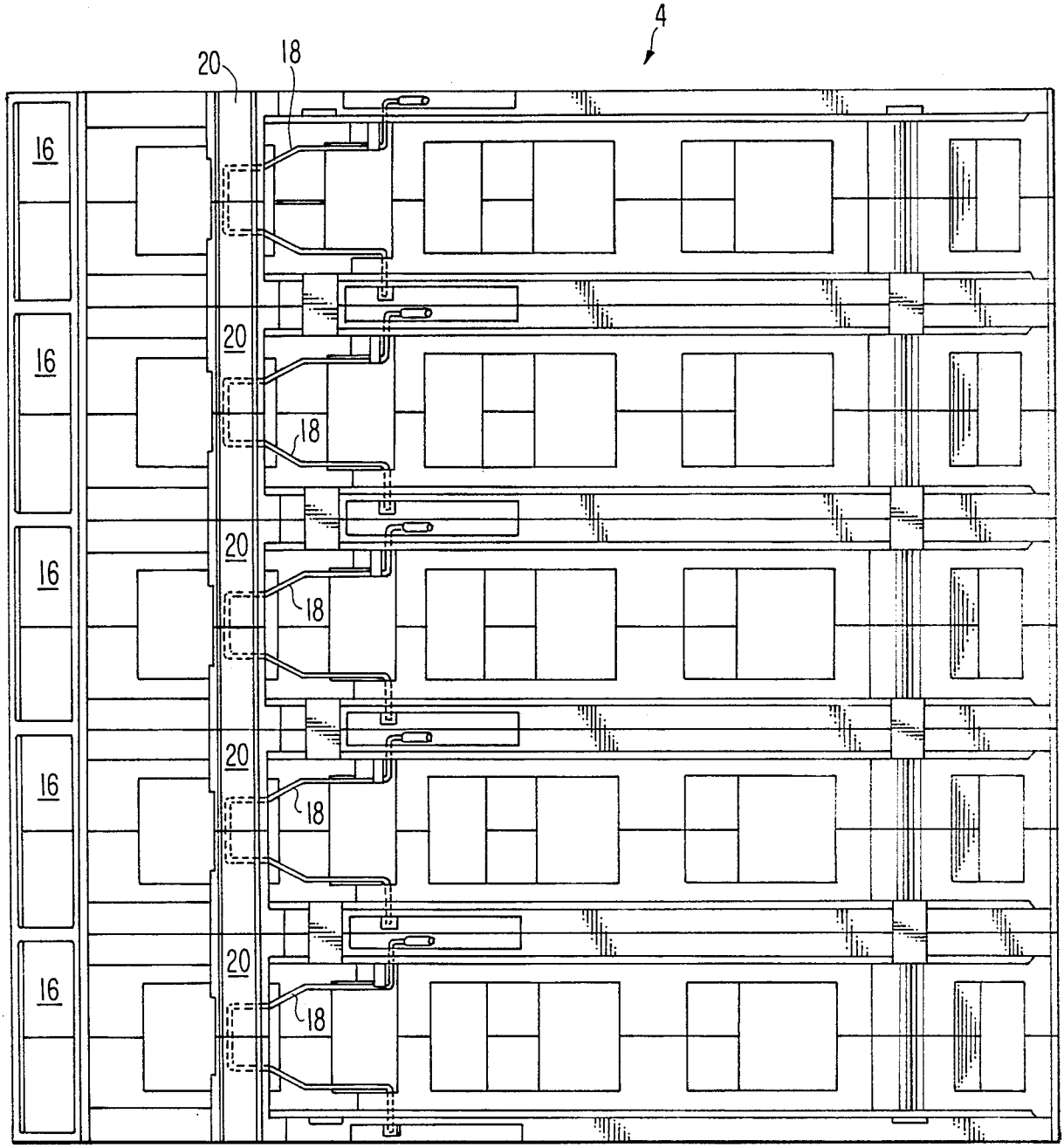
FIG. 3 is a top view of the preferred dispensing rack.

FIG. 3 is a top view of a dispensing tray 4. Tray 4 is arranged to hold five (5) sets of containers, each of which is contained in parallel courses extending from the front to the rear of the tray. Each of the courses comprises an upper course and a lower course. The front of each lower course includes a label holder 16 for containing a label identifying the contents of the containers in that course. The front part of each upper course includes a pivotally-mounted gate 18 which will be described in more detail below. A front stop 20 extends across the front of each upper course and prevents the articles from falling out of the sloped upper course.

Figure 4:
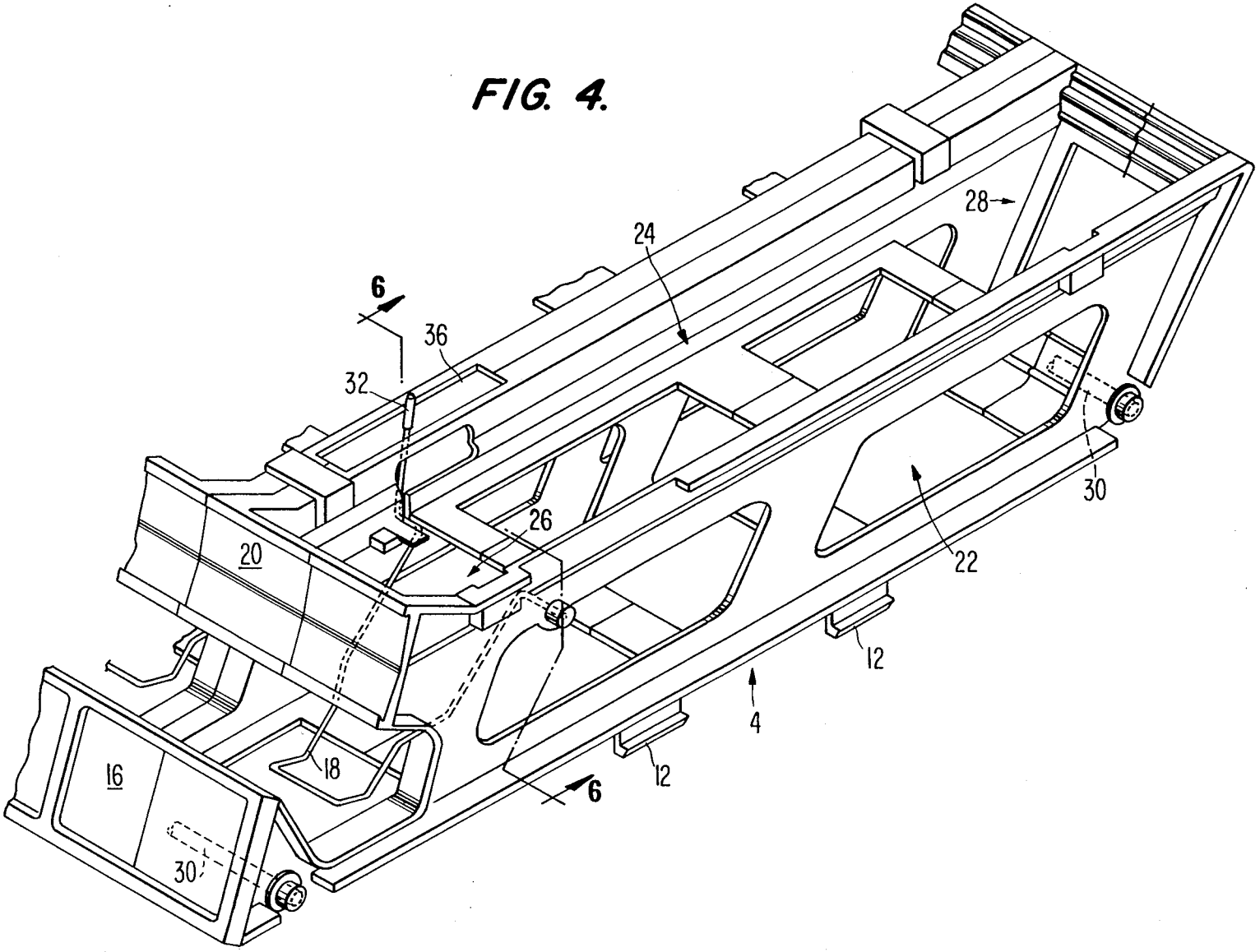
FIG. 4 is a partial perspective of the dispensing tray shown in FIG. 3.

FIG. 4 is a broken perspective of a tray 4 and shows a single pair of upper and lower courses. A lower course 22 is connected to an upper course 24 at both front end 26 and rear end 28. The rear end connection 28 is unobstructed, while the front end connection 26 contains pivotally mounted gate 18.

In the preferred embodiment, each course is manufactured of molded plastic. The courses are molded in two pieces and held together by rods 30.

Figure 5:
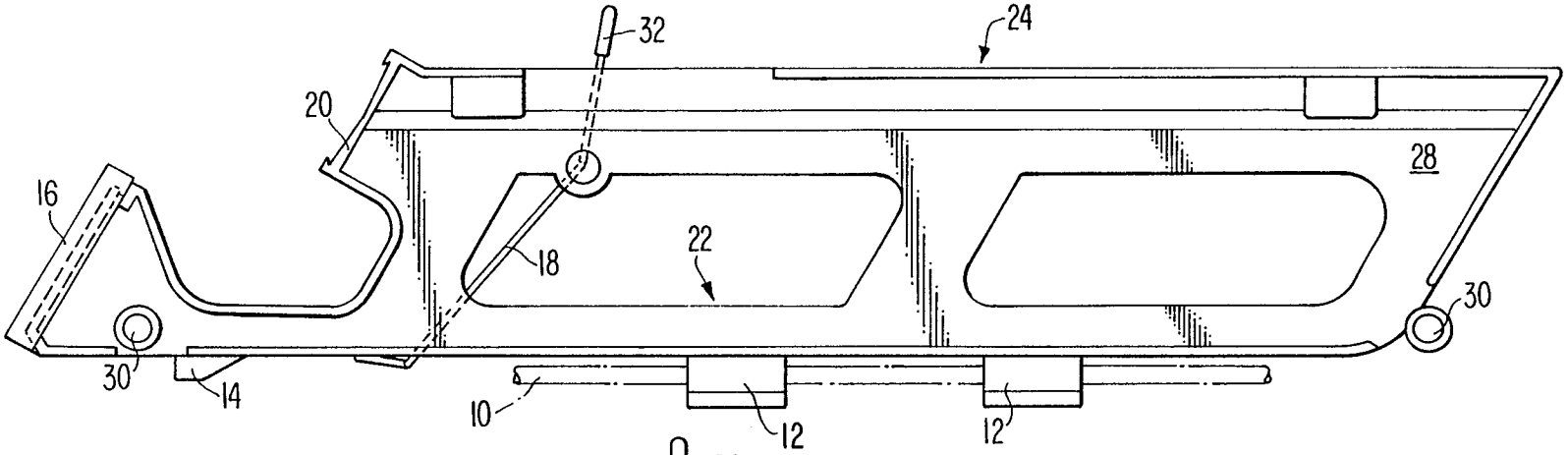
FIG. 5 is a side view of the dispensing tray as shown in FIG. 3.

FIG. 5 is a side view of a dispensing tray 4. In this view, gate 18 is shown in a downward position connecting upper course 24 with lower course 22. In this position, flag 32, which is preferably part of the gate 18, extends upwardly for easy viewing by a supplier. As will be described more fully below, when gate 18 is pivoted upwardly, flag 32 is hidden.

Figure 6:
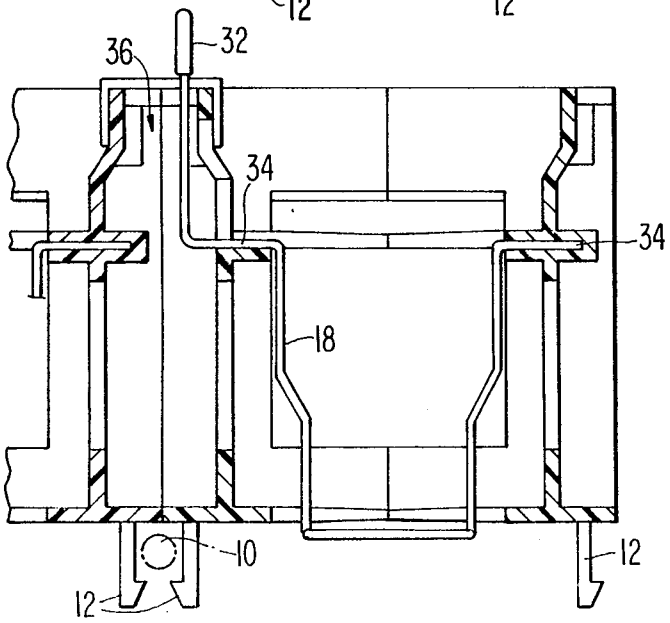
FIG. 6 is a cross-section taken along line 6—6 of FIG. 4.

FIG. 6 is a cross-section taken along line 6—6 of FIG. 4 and shows the preferred manner in which the gate 18 is pivotally mounted. Horizontal sections 34 are received in recesses in the tray and permit easy rotation thereof. Gate 18 is preferably made of bent wire, but may be of many constructions. It will be appreciated that a cavity 36 is formed between adjacent portions of the tray to receive flag 32 when gate 18 is in a raised position.

Operation of the device will now be described with respect to FIGS. 2 and 4. FIG. 2 shows an upper and a lower tray, wherein the lower tray 4 is in a dispensing position and contains a plurality of cylindrical objects 38. Of course, the object could be of other shapes, such as spherical or rectangular. Preferably, these objects are arranged to roll along the downwardly-sloped upper and lower courses so that a front-most object is located at the front of the lower course. If the objects are not round they can slide forward. Thus, it is easily picked up by a shopper. It will be apparent that when the front-most object 38 is removed from lower course 22, objects 38 located behind the removed object will roll forwardly to replace the removed object. This occurs repeatedly until there is only a single front-most object remaining in the lower course. Then, gate 18 pivots downwardly as shown in the upper tray (shown in dashed lines) of FIG. 2. This provides a ramp for objects 38 in the upper course to fall into the front part of the lower course. When the final front-most object is taken from the lower course, gate 18 pivots downwardly, and objects will roll from the upper course into the front part of the lower course by way of gate 18 and consequently provide additional objects for selection by a shopper.

It will be appreciated that the above-described procedure allows the lower course to be fully emptied before objects from the upper course are introduced into the lower course for dispensing.

Furthermore, it will be appreciated that as few as three or four objects will present to a shopper the same view as would a full tray. This results in a reduced inventory requirement for those objects which are seasonal.

When gate 18 rotates to the position shown in the upper tray of FIG. 2, and as shown in FIG. 4, flag 32 becomes visible to alert a supplier to the necessity of re-loading that tray. Loading is accomplished by raising the front part of a tray 4 slightly to allow tab 14 to pass over the front-most bracket 8 and slide outwardly to the position in chained lines in FIG. 2. In this position, a second tab 14 engages bracket 8 to hold the tray in the extended position shown in FIG. 2. Then, the supplier places objects in the upper course by sliding them into the upper course and forcing them to roll upwardly and rearwardly along the upper course. As additional objects are added, they eventually fill the upper course and fall through the connection at rear end 28 into lower course 22. When the additional objects 38 roll into lower course 22, they automatically raise gate 18 such that it is held in the upper position as in the lower tray in FIG. 2. The supplier then slides tray 4 upwardly so that the forward tab 14 again engages the front-most bracket 8 to place the apparatus into its normally-operating position.

Preferably, objects 38 are provided to the supplier in an elongate tube in shrunk-wrapped plastic. One end of the tube may be opened and objects 38 easily rolled into upper course 24 when re-loading a tray.

It will be appreciated that a unique display rack has been disclosed which is easily used by a customer, easily re-stocked, ensures orderly dispensing, and results in reduced inventory requirement. Modifications within the scope of the appended claims will be apparent to those of skill in the art.

We claim:

1. A tray for displaying and dispensing objects comprising first course means for holding a plurality of said objects and having a first end for dispensing said objects and a second end, second course means above said first course means for holding a plurality of said objects, said second course means having a first end for loading said objects and a second end, wherein said first end of said second course means is adjacent said first end of said first course means, means between said first end of said second course means and said first end of said first course means for allowing said objects in said second course means to pass to said first course means and said second end of said second course means is adjacent said second end of said first course means, means between said second end of said second course means and said second end of said first course means for allowing objects in said second course means to pass to said first course means, and further comprising gate means for blocking said mean between said first end of said second course means and said first end of said first course means for preventing passage of said objects from said first end of said second course means to said first end of said first course means until an initial supply of said objects has been removed from said first course means and, guide means for guiding objects between said second end of said second course means and said second end of said first course means.

2. A tray according to claim 1 wherein said gate means comprises a pivotally mounted element which is held in a first position to prevent said objects from passing between said first ends by an object in said first course means.

3. A tray according to claim 2 wherein said gate means pivots to a second position to allow objects to pass from said first end of said second course means to said first end of said first course means and to form a ramp to guide said objects from said first end of said second course means to said first end of said first course means.

4. A tray according to claim 3 wherein said gate means further comprises a flag for visually indicating whether said gate means is in said first or second position.

5. A tray according to claim 4 wherein said first end of said first course means extends forwardly of said first end of said second course means.

6. A tray according to claim 1 in combination with an apparatus for supporting said tray, said apparatus comprising support means for supporting said tray in a position such that said first end of said first course means is exposed for dispensing said objects.

7. The combination according to claim 6 wherein said support means engages said tray to provide first and second positions, said first end of said first course means being exposed in said first position and said first end of said second course means being exposed in said second position.

8. The combination according to claim 7 comprising a plurality of said trays.

9. The combination according to claim 8 further comprising said objects, each of said objects being cylindrical and wherein said first and second course means receive said objects with their cylindrical axes horizontal.

10. The combination according to claim 9 wherein said course means of said trays are sloped downwardly toward a front of the apparatus.

11. A tray according to claim 1, wherein said first end of said first course means extends forwardly of said first end of said second course means and said gate means extends beyond said first end of said second course means when said initial supply of said objects is in said first course means.

12. A tray according to claim 11, wherein said gate means is generally U-shaped.

* * * * *